US007416001B2

(12) United States Patent
Speck

(10) Patent No.: US 7,416,001 B2
(45) Date of Patent: Aug. 26, 2008

(54) APPEARANCE-CHANGEABLE WALLET

(76) Inventor: Alicia Speck, 1230 S. 110th St., Omaha, NE (US) 68144

( * ) Notice: Subject to any disclaimer, the term of this patent is extended or adjusted under 35 U.S.C. 154(b) by 0 days.

(21) Appl. No.: 11/409,293

(22) Filed: Apr. 21, 2006

(65) Prior Publication Data

US 2006/0237107 A1 Oct. 26, 2006

Related U.S. Application Data

(60) Provisional application No. 60/673,698, filed on Apr. 21, 2005.

(51) Int. Cl.
*A45C 1/06* (2006.01)
*A45C 11/18* (2006.01)

(52) U.S. Cl. ..... 150/131; 150/105; 150/113

(58) Field of Classification Search ..... 150/103–105, 150/131–135, 147–150, 113; 206/39; 190/901, 190/903, 110; 383/111
See application file for complete search history.

(56) References Cited

U.S. PATENT DOCUMENTS 2,187,375 A * 1/1940 Florin ..... 150/133
2,326,615 A * 8/1943 Allen ..... 150/105
2,335,051 A * 11/1943 Gardner ..... 150/136
3,483,909 A * 12/1969 Mascolo et al. ..... 150/139
3,536,116 A * 10/1970 Margolis ..... 150/103
3,543,825 A * 12/1970 Dobbs ..... 150/113
3,770,034 A * 11/1973 Eastman ..... 150/146
4,852,293 A * 8/1989 Levine et al. ..... 43/54.1
5,894,975 A * 4/1999 Holden et al. ..... 224/582
6,003,573 A * 12/1999 Owens ..... 150/104
2002/0060166 A1* 5/2002 Johnson ..... 206/425
2005/0067246 A1* 3/2005 Teicher et al. ..... 190/124
2006/0180487 A1* 8/2006 Chan et al. ..... 206/373

FOREIGN PATENT DOCUMENTS

FR 2636510 A1 * 3/1990

* cited by examiner

*Primary Examiner*—Sue A Weaver

(57) ABSTRACT

A appearance-changeable wallet includes an inner item-carrying section having an outer side and an inner side and at least two generally planar outer cover sections having inner and outer sides which is adapted to fit over and substantially cover the outer side of the inner item-carrying section, each of the outer sides of the at least two generally planar outer cover sections having a different outer side external appearance. A releasable fastening device is operative to releasably attach a selected one of the at least two outer cover sections having a first outer side external appearance to the outer side of the inner item-carrying section and by releasing the releasable fastening device and connecting another of the outer cover sections having a second outer side external appearance thereto, the external appearance of the appearance-changeable wallet is able to be changed and coordinated with other selected accessories.

10 Claims, 3 Drawing Sheets

APPEARANCE-CHANGEABLE WALLET

CROSS-REFERENCE TO RELATED PROVISIONAL PATENT

This application claims priority based on a provisional patent, specifically on the Provisional Patent Application Ser. No. 60/673,698 filed Apr. 21, 2005.

BACKGROUND OF THE INVENTION

1. Technical Field

The present invention is directed to wallets and, more particularly, to a wallet incorporating an inner item-carrying section and an outer cover section, the inner item-carrying section attachable to the outer cover section by one or more fastening devices, such that the inner item-carrying section may be quickly and easily removed from connection with one outer cover section having a particular external appearance and connected to another outer cover section having a different external appearance to permit the inner item-carrying section and the materials carried therein to be coordinated with various fashions.

2. Description of the Prior Art

Wallets and purses are not only used for carrying personal items such as identification cards and credit cards, but also are used to accessorize the appearance of the person carrying the wallet and/or purse. The variety of wallets and purses currently being sold attests to the use of them for appearance enhancement, particularly among the rich and famous. However, for many persons, it is impractical or impossible to own a large variety of wallet types in various designs and colors, and thus the person is unable to coordinate the wallet with various fashions and purse styles. Even having a few wallets of different colors and designs would allow coordination of the wallet with the majority of purses and outfits, but this raises another issue, namely that one must transfer his or her personal items between the wallets each and every time that he or she wants to coordinate a different wallet with a purse or outfit. This greatly increases the opportunity for the personal items to be lost or misplaced during the transfer, and thus is not a practical solution to the above-described problem. There is therefore a need for an appearance-changeable wallet which will easily and quickly transfer personal items between wallets of differing appearances while still having a presentable and desirable appearance.

There are numerous examples from the prior art relating to purses which include interchangeable covers for modifying the external appearance of the purse, and these include such devices as found in McCreery, U.S. Pat. No. 6,543,499, Salz, U.S. Pat. No. 6,186,201, Sutton, U.S. Pat. No. 6,179,025, and Holden et al., U.S. Pat. No. 5,894,975. While each of these prior art inventions disclose purses having external appearance-modifying devices such as replaceable outer shells, nowhere in the prior art is it currently found to provide such a modification system for a wallet which fits within the purse. There is a simple reason that most women have a plurality of purses yet only one wallet, and that is that the wallet may be quickly and easily transferred between the various purses when the purse is to be used by the owner, thus permitting the purse owner to keep all of her valuable credit cards, licenses and other items in one easily transportable carrying device. These various purses, however, will invariably include different external appearances, and therefore there is a need for a simple and effective device which will permit the external appearance of the wallet to be modified or changed to correspond to the purse in which the wallet is being carried.

Therefore, an object of the present invention is to provide an improved appearance-changeable wallet.

Another object is to provide an appearance-changeable wallet which incorporates an inner item-carrying section and outer cover section, the inner item-carrying section attachable to the outer cover section by one or more fastening devices such that the inner item-carrying section may be quickly and easily removed from connection with one outer cover section having a particular external appearance and connected to another outer cover section having a different external appearance.

Another object of the present invention is to provide an appearance-changeable wallet which can be used with many different outer cover sections which will generally correspond with the external appearance of any selected purse to be used by the user of the present invention.

Another object of the present invention is to provide an appearance-changeable wallet which may be constructed of cloth, leather, denim, or virtually any generally flexible wallet construction material in order to ensure that the appearance of the outer cover section will correspond to a selected purse style.

Another object of the present invention is to provide an appearance-changeable wallet in which the inner item-carrying section is connected to the outer cover section by a zipper, snaps, or another such releasable securement device in order to promote the simple and efficient swapping of outer cover sections when connected to the inner item-carrying section.

Finally, an object of the present invention is to provide an improved appearance-changeable wallet which is relatively simple and durable in design and construction and is safe, efficient and effective in use.

SUMMARY OF THE INVENTION

The present invention provides an appearance-changeable wallet which includes an inner item-carrying section having an outer side and an inner side having at least one item-carrying receptacle for carrying items therein and at least two generally planar outer cover sections adapted to fit over and substantially cover the outer side of the inner item-carrying section, each of the at least two generally planar outer cover sections including an inner side and an outer side, each of the outer sides of the at least two generally planar outer cover sections having a different outer side external appearance. A releasable fastening device such as clips, snaps or a zipper is mounted on at least one of the outer side of the inner item-carrying section and the inner sides of the at least two outer cover sections, the releasable fastening device operative to releasably attach a selected one of the at least two outer cover sections to the outer side of the inner item-carrying section. Finally, the inner item-carrying section is separable from a selected one of the at least two outer cover sections having a first outer side external appearance by releasing of the releasable fastening device and then connectable to another of the at least two outer cover sections having a second outer side external appearance via engagement of the releasable fastening device whereby the external appearance of the appearance-changeable wallet is able to be coordinated with other selected accessories.

The appearance-changeable wallet as thus described provides a substantial improvement over many of the devices found in the prior art. For example, while there are numerous examples found in the prior art which disclose appearance-changeable purses, the same cannot be said for wallets, and therefore the present invention is unique among other inventions. Furthermore, because it is a simple matter to swap one outer cover section for another outer cover section for connection to the inner item-carrying section, the external appearance of the wallet may be quickly modified and changed to correspond to any selected purse, thus making it a simple and enjoyable process to use the present invention. Finally, because the outer cover section is generally the portion of the wallet which receives the most damage from abrasions and impacts, the fact that the outer cover section may be removed and replaced means that the life span of the appearance-changeable wallet of the present invention will likely be substantially extended, thus presenting significant savings for consumers and users of the present invention. It is thus seen that the improved appearance-changeable wallet of the present invention provides a substantial improvement over those devices found in the prior art.

DESCRIPTION OF THE PREFERRED EMBODIMENT

Figure 1:
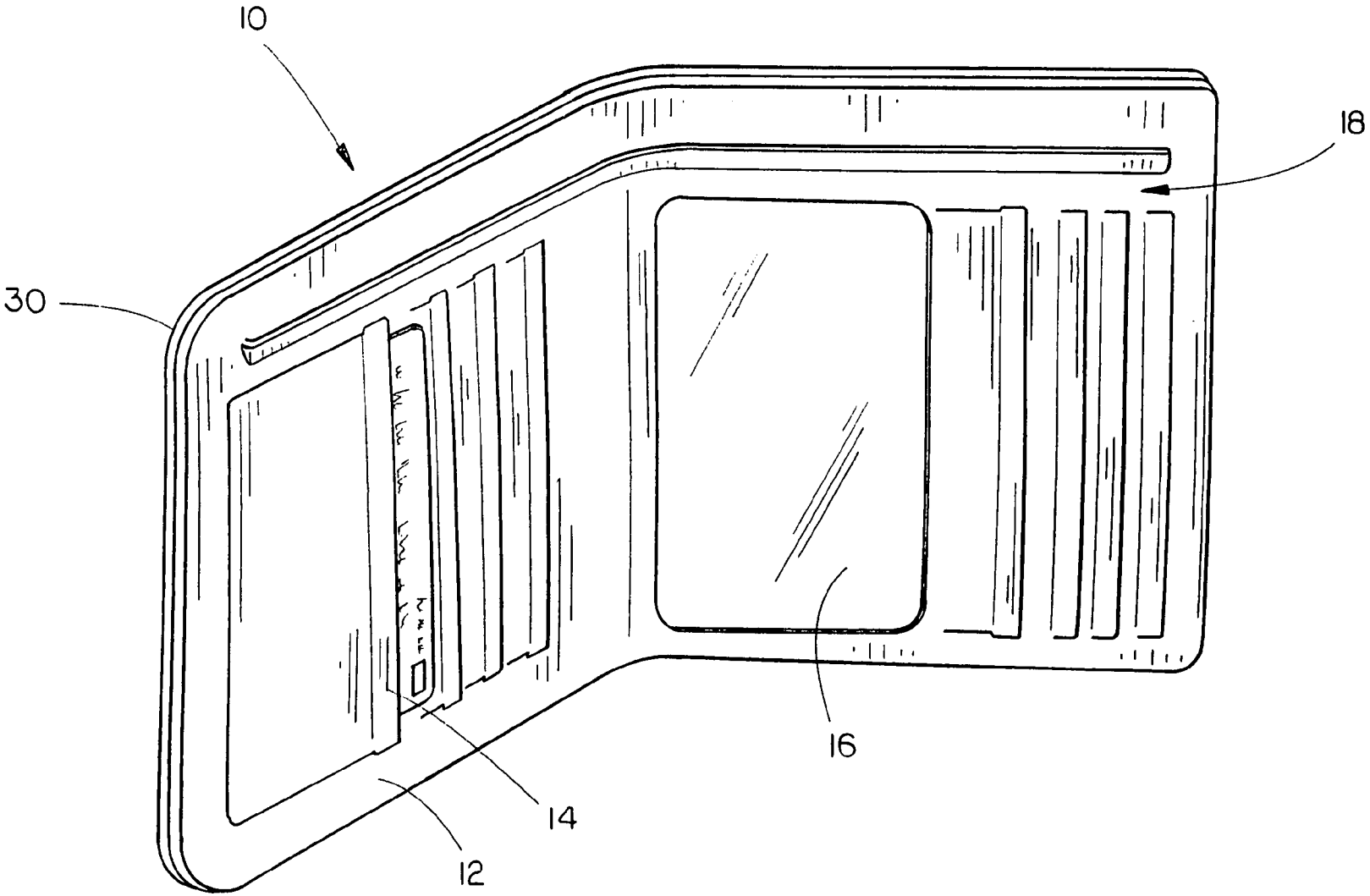
FIG. 1 is a detailed perspective view of the wallet of the present invention.
Figure 2:
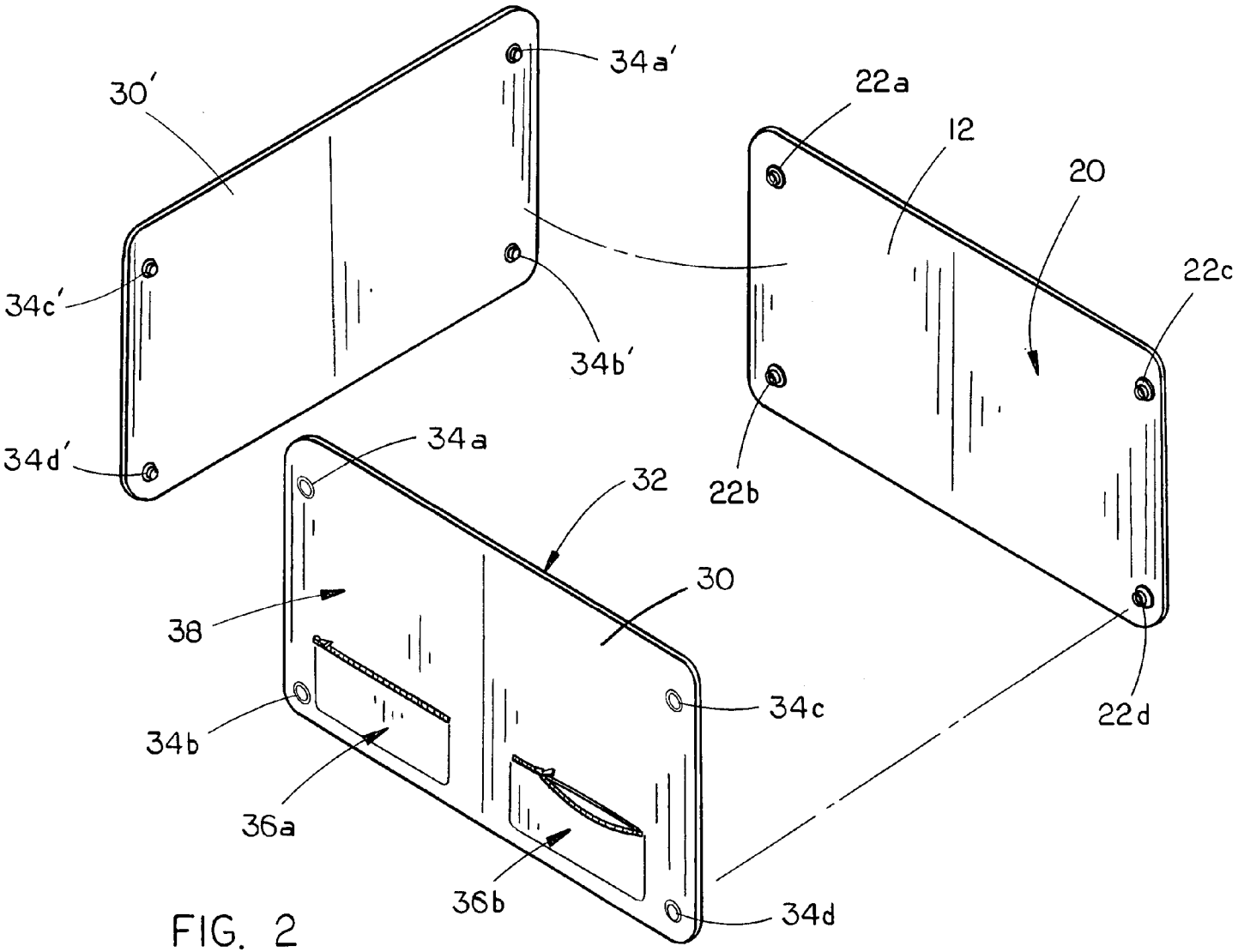
FIG. 2 is a perspective view of the present invention showing the inner item-carrying section being transferred between outer cover sections having different appearances.
Figure 3:
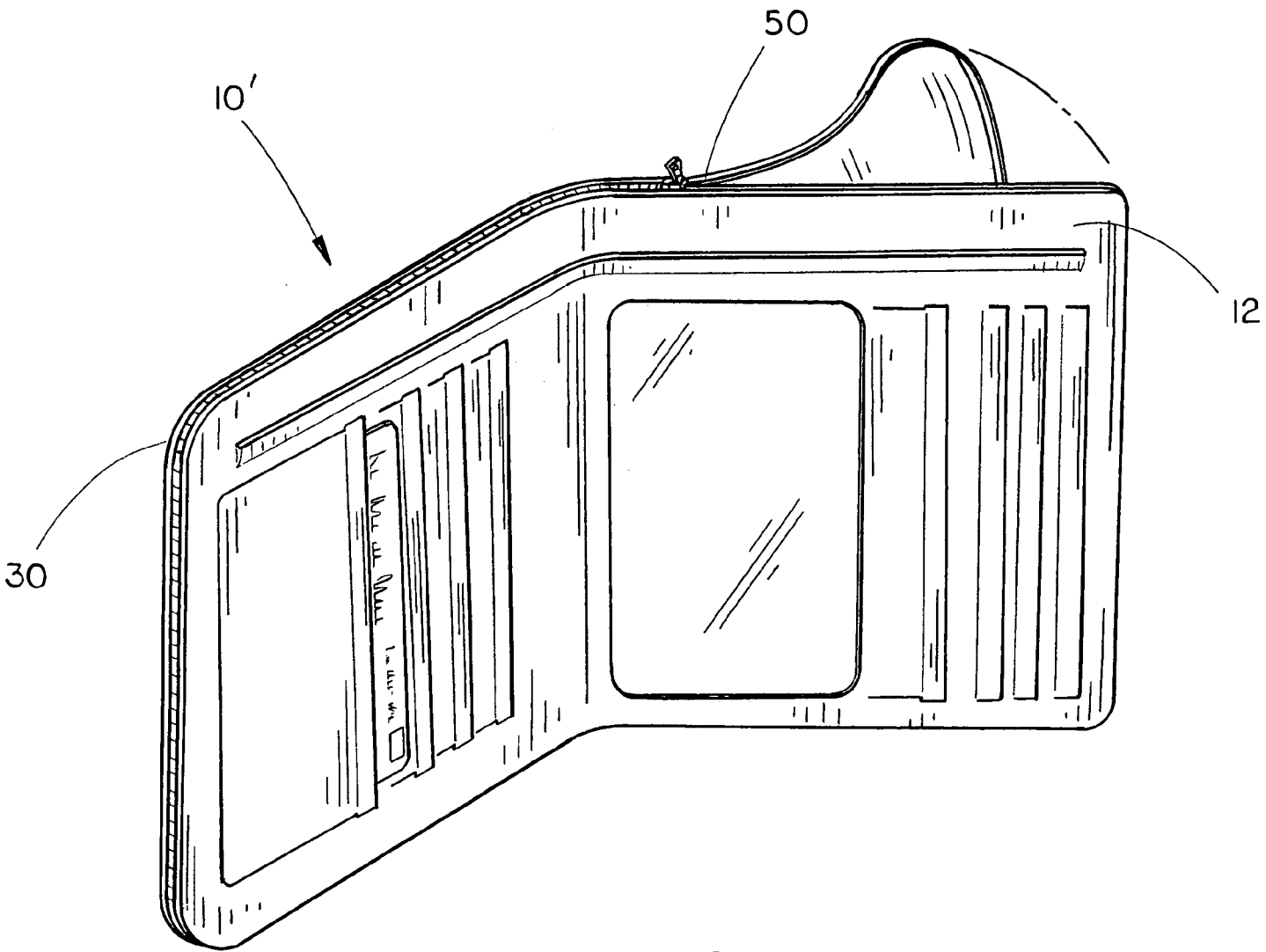
FIG. 3 is a perspective view of the wallet of the present invention showing the inner and outer sections being connected to one another by a zipper.

The wallet 10 of the present invention is shown best in FIGS. 1-3 as including an inner item-carrying section 12 and an outer cover section 30. In the preferred embodiment, the inner item-carrying section 12 would be constructed of a fabric or leather material sewn or glued using standard wallet manufacturing techniques and would include a plurality of pockets 14, including an identification card-carrying pocket 16, although the specific number, shape, and sizes of the pockets 14 is not critical to the present invention so long as the pockets 14 are designed to carry and securely store items therein. The pockets 14 would be formed on the inner surface 18 of the inner item-carrying section 12, and a plurality of securement snaps 22*a*, 22*b*, 22*c*, and 22*d* would be mounted on the outer side 20 of the inner item-carrying section 12, as shown best in FIG. 2. The snaps 22*a-d* are designed to engage and be retained within corresponding snaps 34*a*, 34*b*, 34*c*, and 34*d* which are mounted on the inner side 32 of outer cover section 30, as shown in FIG. 2. In the preferred embodiment, the snaps 22*a-d* and 34*a-d* may be of any appropriate design, so long as the snaps securely and releasably connect the inner item-carrying section 12 to the outer cover section 30 when snaps 22*a-d* are engaged with snaps 34*a-d*. Of course, the specific location of the snaps 22*a-d*, as well as the number of snaps used may be modified or changed depending on the strength and position of the connections between the inner item-carrying section 12 and outer cover section 30 desired by the user and/or manufacturer of the present invention. It has been found, however, that a set of snaps 22*a-d* and 34*a-d* positioned around the perimeter of the inner item-carrying section 12 and outer cover section 30, along with possibly one or two other snaps adjacent the center of the inner item-carrying section 12 and outer cover section 30, provides sufficient securement to connect the inner item-carrying section 12 with outer cover section 30.

One of the important features of the present invention is that the outer cover section 30 is replaceable with alternative outer cover sections 30' such as that shown in FIG. 2. Specifically, the size and appearance of the outer cover section 30 and 30' may be changed to coordinate with various types of purses, outfits, and other accessories in order to permit the wallet 10 of the present invention to be used regardless of the particular outfit or accessory being worn or carried by the user of the present invention. For example, outer cover section 30, as shown in FIG. 2, may be constructed of black leather with a pair of external pockets 36*a* and 36*b* mounted on the outer surface 38 of the outer cover section 30. Outer cover section 30', however, might be constructed of a pastel-colored fabric material which presents a substantially different appearance than outer cover section 30. Ordinarily, owners of standard wallets and purses would have to transfer all of their personal items from the first wallet to the second wallet for use with a different outfit or accessory, but, with the present invention, the user need merely detach the inner item-carrying section 12 from outer cover section 30 and reattach inner item-carrying section 12 to outer cover section 30' to immediately and easily change the external appearance of the wallet 10 without having to remove or replace personal items from the inner item-carrying section 12. The variety in the size, shape, construction materials used and appearance of outer cover section 30 is virtually unlimited, and thus the external appearance of the outer cover section 30 may be designed to coordinate with virtually any type of outfit or accessory with which the wallet 10 of the present invention is to be used. It is expected that an owner of the wallet 10 of the present invention would have a single inner item-carrying section 12 in which all of his or her personal items are stored and would further have a plurality of outer cover sections 30 designed to coordinate with his or her various outfits and accessories, such as purses, handbags, or other such personal accessories. It is a relatively simple matter to transfer the inner item-carrying section 12 of the present invention to one of the outer cover sections 30 and 30' merely by disengaging the snaps 22*a-d* from snaps 34*a-d* and reconnecting snaps 22*a-d* to the new set of snaps 34*a'-d'* on outer cover sections 30 and 30'. This ability to change the appearance of the wallet 10 is not found in the prior art and thus represents a substantial improvement.

FIG. 3 shows an alternative embodiment of the wallet 10' of the present invention in which the inner item-carrying section 12 is connected to outer cover section 30 by a zipper 50 which is designed to either replace or enhance the connections provided by snaps 22*a-d* and snaps 34*a-d* shown in FIGS. 1 and 2. In the embodiment of FIG. 3, the zipper 50 would extend around the outer perimeter of the inner item-carrying section 12 and outer cover section 30 and connect the two sections to one another to create the single unit of wallet 10'. Of course, numerous other types of connection devices may be substituted for the zipper 50 and snaps 22*a-d* and 34*a-d* described herein, any of which would be understood by those skilled in the art of item connection devices.

It is to be understood that numerous additions, substitutions, and modifications may be made to the wallet 10 of the present invention which fall within the intended broad scope of the above description. For example, the size, shape, and construction materials used in connection with the inner item-carrying section 12 and outer cover section 30 may be modified or changed depending upon the function and appearance desired by the user of the present invention. Also, the precise number of pockets 14 mounted on the inner side 18 of inner item-carrying section 12 may be modified or changed again depending on the desires and the needs of the user of the present invention. Furthermore, the specific connection devices used to connect inner item-carrying section 12 to outer cover section 30 may be modified or changed from the snaps 22*a-d* and 34*a-d* or zipper 50 currently described, so long as the connection devices securely and releasably connect the inner item-carrying section 12 to outer cover section 30 in the manner generally described above. Finally, the specific appearance of the outer surface 38 of outer cover section 30 may be modified or changed depending on the specific outfit, accessory, purse, pocketbook, or other such item the wallet 10 of the present invention is intended to coordinate with, and the modification of the appearance of outer cover section 30 should be understood to be a part of this disclosure.

There has therefore been shown and described a wallet 10 which accomplishes at least all of its intended objectives.

I claim:

1. An appearance-changeable wallet comprising:

an inner item-carrying section including an outer side and an inner side having at least one item-carrying receptacle for carrying items therein;

at least two generally planar outer cover sections adapted to fit over and substantially cover said outer side of said inner item-carrying section, each of said at least two generally planar outer cover sections including an inner side and an outer side, each of said outer sides of said at least two generally planar outer cover sections having a different outer side external appearance;

releasable fastening means mounted on at least one of said outer side of said inner item-carrying section and said inner sides of said at least two outer cover sections, said releasable fastening means operative to releasably attach a selected one of said at least two outer cover sections to said outer side of said inner item-carrying section;

said inner item-carrying section being separable from a selected one of said at least two outer cover sections having a first outer side external appearance by releasing of said releasable fastening means and then connectable to another of said at least two outer cover sections having a second outer side external appearance via engagement of said releasable fastening means whereby the external appearance of said appearance-changeable wallet is able to be coordinated with other selected accessories; and said releasable fastening means being a zipper mounted on and extending around the outer perimeter of said inner item-carrying section and said at least two outer cover sections, said zipper operative to connect said inner item-carrying section and a selected one of said at least two outer cover sections whereby they are releasably secured to one another via said zipper.

2. The appearance-changeable wallet of claim 1 wherein said at least one item-carrying receptacle of said inner item-carrying section further comprises a plurality of pockets.

3. The appearance-changeable wallet of claim 1 wherein said at least two generally planar outer cover sections each comprise generally rectangular planar sheets of flexible construction material.

4. The appearance-changeable wallet of claim 1 wherein said releasable fastening means further comprises a plurality of securement snaps mounted on said outer side of said inner item-carrying section and a plurality of corresponding snaps mounted on said inner side of said at least two outer cover sections, said plurality of securement snaps and said plurality of corresponding snaps operative to engage one another and be releasably retained thereby such that said inner item-carrying section and a selected one of said at least two outer cover sections are releasably secured to one another via said securement snaps.

5. The appearance-changeable wallet of claim 4 wherein at least some of said plurality of securement snaps mounted on said outer side of said inner item-carrying section and at least some of said plurality of corresponding snaps mounted on said inner side of said at least two outer cover sections are mounted around the perimeter of each of said outer side of said inner item-carrying section and said inner side of said at least two outer cover sections.

6. An appearance-changeable wallet comprising:

an inner item-carrying section including an outer side and an inner side having at least one item-carrying receptacle for carrying items therein;

a first generally planar outer cover section adapted to fit over and at least mostly cover said outer side of said inner item-carrying section, said first generally planar outer cover section including an inner side and an outer side;

a second generally planar outer cover section adapted to fit over and substantially cover said outer side of said inner item-carrying section, said second generally planar outer cover section including an inner side and an outer side;

each of said outer sides of said first and second generally planar outer cover sections having a different outer side external appearance;

releasable fastening means mounted on said outer side of said inner item-carrying section and said inner side of said first outer cover sections, said releasable fastening means operative to releasably attach said first outer cover section to said outer side of said inner item-carrying section;

said inner item-carrying section being separable from said first outer cover section having a first outer side external appearance by releasing of said releasable fastening means and then connectable to said second outer cover section having a second outer side external appearance via engagement of said releasable fastening means whereby the external appearance of said appearance-changeable wallet is changeable; and said releasable fastening means being a zipper mounted on and extending around the outer perimeter of said inner item-carrying section and said at least two outer cover sections, said zipper operative to connect said inner item-carrying section and a selected one of said at least two outer cover sections whereby they are releasably secured to one another via said zipper.

7. The appearance-changeable wallet of claim 6 wherein said at least one item-carrying receptacle of said inner item-carrying section further comprises a plurality of pockets.

8. The appearance-changeable wallet of claim 6 wherein said at least two generally planar outer cover sections each comprise generally rectangular planar sheets of flexible construction material.

9. The appearance-changeable wallet of claim 6 wherein said releasable fastening means further comprises a plurality of securement snaps mounted on said outer side of said inner item-carrying section and a plurality of corresponding snaps mounted on said inner side of said at least two outer cover sections, said plurality of securement snaps and said plurality of corresponding snaps operative to engage one another and be releasably retained thereby such that said inner item-carrying section and a selected one of said at least two outer cover sections are releasably secured to one another via said securement snaps.

10. The appearance-changeable wallet of claim 9 wherein at least some of said plurality of securement snaps mounted on said outer side of said inner item-carrying section and at least some of said plurality of corresponding snaps mounted on said inner side of said at least two outer cover sections are mounted around the perimeter of each of said outer side of said inner item-carrying section and said inner side of said at least two outer cover sections.

* * * * *